United States Patent [19]

Bell, Jr. et al.

[11] Patent Number: 4,598,817

[45] Date of Patent: Jul. 8, 1986

[54] LOADING SYSTEM FOR A TOE CLOSING ASSEMBLY

[75] Inventors: Cecil R. Bell, Jr., Pinnacle; Willie M. Lathery, Germanton; Navin D. Patel; Jasper R. London, both of Winston-Salem, all of N.C.

[73] Assignee: Sara Lee Corporation, Winston-Salem, N.C.

[21] Appl. No.: 755,790

[22] Filed: Jul. 17, 1985

Related U.S. Application Data

[62] Division of Ser. No. 297,315, Aug. 28, 1981, Pat. No. 4,539,924.

[51] Int. Cl.[4] ..... B65G 25/00

[52] U.S. Cl. ..... 198/468.2; 198/487.1; 112/262.2; 112/262.3

[58] Field of Search ..... 112/121.15, 121.11, 112/121.12, 262.2, 262.3; 198/468.2, 487.1, 803.7, 803.9, 803.12; 414/222, 225, 226

[56] References Cited

U.S. PATENT DOCUMENTS

| | | | |
|---|---|---|---|
| 3,738,294 | 6/1973 | Christiansen | 112/121.15 |
| 3,941,069 | 3/1976 | Fukuyama | 112/121.15 X |
| 4,133,276 | 1/1979 | Selvi | 112/121.15 |
| 4,192,242 | 3/1980 | Haselgrove et al. | 112/121.15 X |
| 4,364,320 | 12/1982 | Nakhle et al. | 112/262.2 |
| 4,425,996 | 1/1984 | Hoffmann | 198/803.7 |
| 4,492,298 | 1/1985 | Zapletal et al. | 198/468.2 |

*Primary Examiner*—H. Hampton Hunter

*Attorney, Agent, or Firm*—Charles Y. Lackey; William S. Burden

[57] ABSTRACT

A system for automatically orienting hosiery blanks upon a conveyor, selectively transferring blanks from the conveyor to a turret assembly by means of a pick-up assembly, the turret assembly including a plurality of support units for sequentially conveying a plurality of blanks in an arcuate path to an automatic toe closing machine, everting the blanks and sewing closed the toe portions of the blanks.

6 Claims, 18 Drawing Figures

LOADING SYSTEM FOR A TOE CLOSING ASSEMBLY

This is a division of application Ser. No. 297,315 filed Aug. 28, 1981 now U.S. Pat. No. 4,539,924, dated Sept. 10, 1975.

BACKGROUND, BRIEF SUMMARY AND OBJECTS OF THE INVENTION

The present invention is directed to an apparatus for and method of handling a plurality of hosiery blanks supplied from a series of knitting machines or other source, orienting the blanks in a prescribed manner, automatically transferring the blanks to an automatic toe closer machine and closing the toe portions of the blanks.

In the past it has been the common practice to close the toes of hosiery blanks by having an operator pick up the welt portion of a blank and hold the toe ends in front of a suction tube of a toe closing machine as disclosed, for example, by U.S. Pat. Nos. 3,941,069 and 3,859,938. The operator manually everts the blank on the machine and the toe is positioned for subsequent sewing.

In an effort to eliminate some of the manual operations required in loading toe closing machines, the system has been developed as disclosed in copending U.S. patent application Ser. No. 06-236,884 filed Feb. 23, 1981. In this disclosure, an operator manually places a blank on a finger of a rotatable arm assembly.

The present invention provides for automatically closing the toe portions of hosiery blanks wherein the manual loading of blanks upon a tube or unloading fingers has been eliminated. In one embodiment of the system, the blanks are conveyed automatically from knitting machines, oriented in a prescribed manner upon conveyor means, selectively directed to one of a series of loading units which in turn, transport the blanks to toe closing machines where the blanks are everted and then sewn. In another embodiment, an operator uses a wand to pneumatically pick up sequentially blanks from a supply station where they are automatically oriented and directed to a toe closing machine.

In one embodiment, the turret assembly includes support fingers displaceable between collapsed and expanded positions by fluid cylinders, in another embodiment the support fingers are opened and closed by a cam arrangement, and in a third embodiment the support fingers rotate in horizontal planes to release the hosiery blank.

One of the primary objects of the invention is a provision of a new and improved system for conveying hosiery blanks from a knitting machine or a supply station and automatically loading the blanks onto tubes of an automatic toe closing machine.

Another object of the invention is a provision of a spreader assembly for facilitating positioning of the blanks onto support fingers of a turret assembly.

An important object of the invention is a provision of a new and improved system which increases production, reduces expense and eliminates substantially all manual operations.

Other features and advantages of the invention will become apparent when considered in view of the following detailed description.

IN THE DRAWING

DETAILED DESCRIPTION OF THE INVENTION

Figures 1, 9:
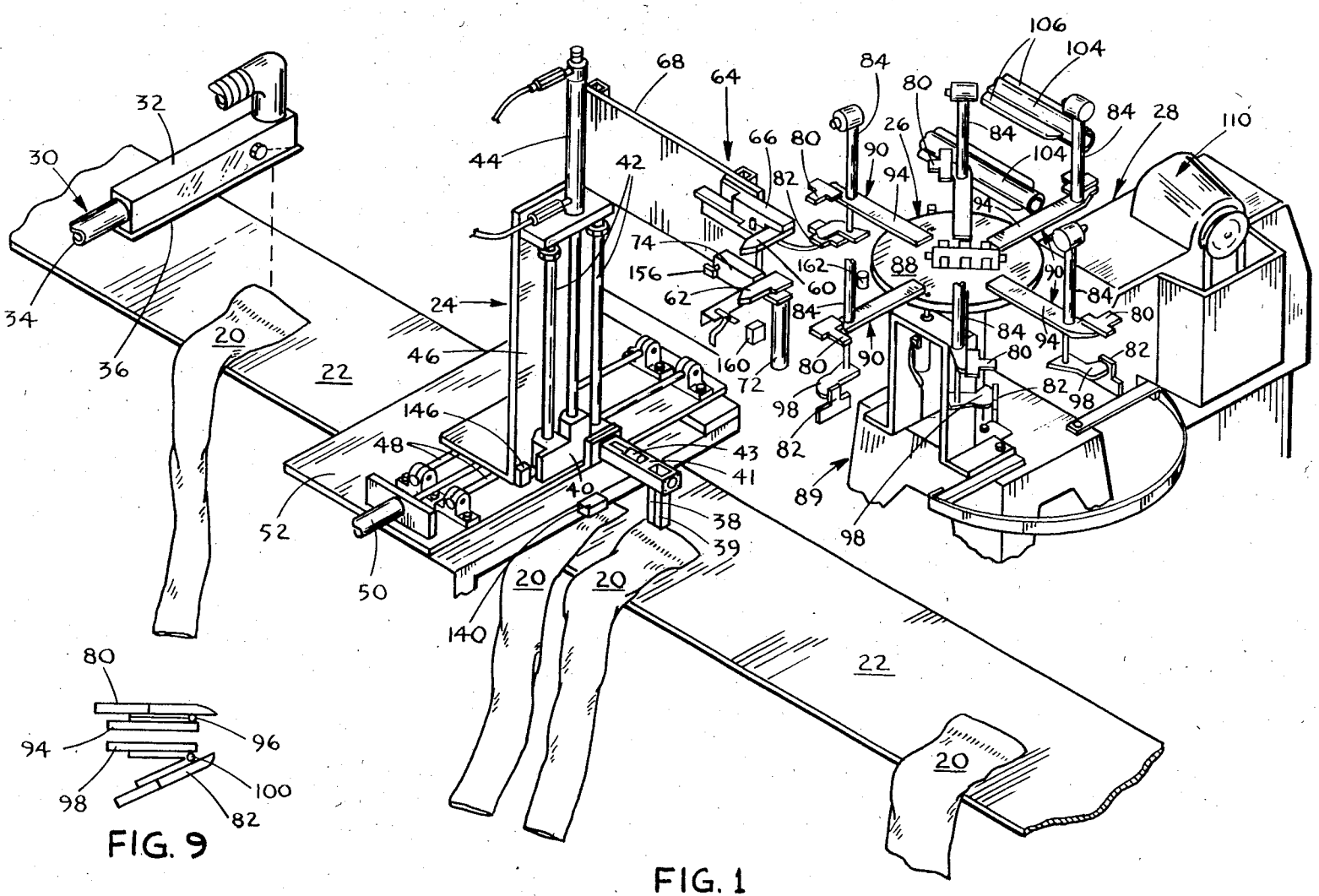
FIG. 1 is a schematic, fragmentary, perspective view of one embodiment of the apparatus including a garment blank orienting assembly, a garment blank pick-up assembly, a turret assembly including garment blank supporting fingers, and a toe closing machine.
FIG. 9 is an enlarged, schematic, side elevational view of the loading fingers and supports therefor.

Referring to the drawing, and initially to FIG. 1, hosiery blanks 20 are oriented upon a driven conveyor 22 in a prescribed position for subsequent pick-up by an assembly 24 which positions the blank so as to be conveyed by turret assembly 26 to a toe closing machine 28. The blanks 20 may be advanced sequentially by a pneumatic conveyor assembly 30 from a supply means or directly from one or more knitting machines, as will be subsequently described. The pneumatic conveyor assembly includes a device 32 for orienting the blanks 20 such that they are selectively positioned with the welt end upon the conveyor 22 and with the toe end depending from the conveyor belt. The device 32 may be of the type disclosed in U.S. Pat. No. 4,099,789. As soon as a blank 20 has entered the device 32 through conduit 30, the conveying air flow is cut off, and the weight of the blank causes the door 36 to open. Air jets within the device 32 act upon the blank and tend to extend it in opposite directions as it is being discharged from the device 32, so as to deposit the blank on the conveyor belt 22, as shown by FIG. 1.

The pick-up assembly 24 is positioned above the belt 22 and includes pick-up fingers 38, 39 for pinching the upper portion of the welt of the blank 20. The fingers 38, 39 are supported by a carriage 40 which may be displaced in a substantially vertical plane along spaced, parallel guide rods 42 by means of a fluid cylinder 44. The cylinder 44 and guide rods 42 are attached to a second carriage 46 which, in turn, may be displaced in a horizontal plane upon guide rods 48 by a fluid cylinder 50. The guide rods 48 and cylinder 50 are attached to a support 52. The outermost pick-up finger 39 is fixed to a bracket 41 which is attached to carriage 40. The finger 38 is capable of being displaced relative to finger 39 and bracket 41 by a double acting fluid cylinder 43 mounted upon bracket 41. Alternatively, the fingers for gripping the welt portion fabric may be of the type disclosed by U.S. Pat. No. 3,902,750.

Figure 3A:
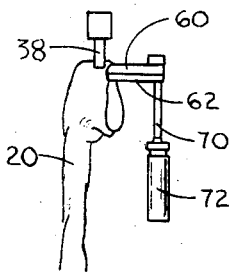
FIGS. 3A–3D are schematic side elevational views of the sequential steps in spreading the welt end of a garment blank and loading of the blank on two displaceable support fingers of the turret of FIG. 1.

As a blank is conveyed by belt 22 to a selected location, the fingers 38, 39 are activated for gripping the upper portion only of the blank welt. At the same time the fluid cylinders 44 and 50 are controlled in a selected manner to raise the gripped blank welt portion from the conveyor and to displace the welt portion laterally of the belt 22 to position the blank welt portion over the closed fingers 60, 62 of the spreader apparatus 64, shown by FIG. 3A.

The spreader finger 60 is attached to a bracket 66 which projects from a fixed support member 68. Finger 62 is displaceable relative to finger 60 and is secured to the rod 70 of a fluid cylinder 72. The cylinder 72 is fastened to a fixed support 74 and the rod 70 extends through an opening, not shown, in the support.

Figure 3B:
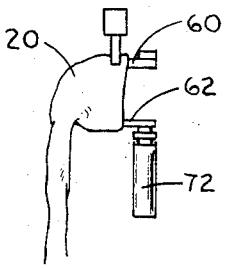
Figure 3C:
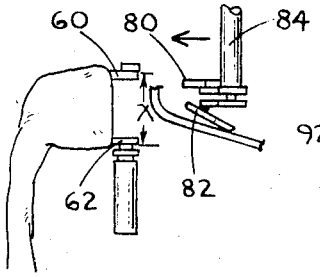
Figure 3D:
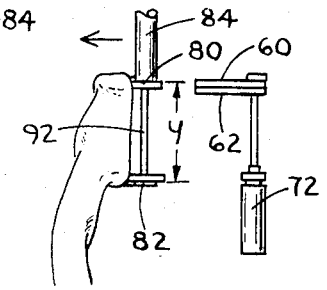
Figure 6:
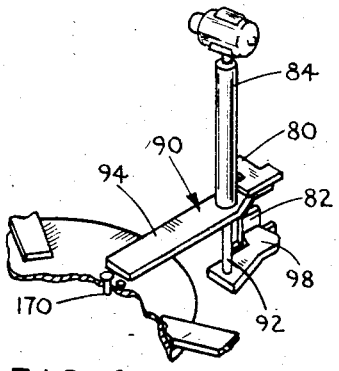
FIG. 6 is a fragmentary perspective view of the mechanism for controlling the opening and closing of the turret garment blank support fingers.

As can be seen from FIGS. 3B–3D, the cylinder 72 is activated to displace finger 62 relative to fixed finger 60 and at least partially spread open and welt end of blank 20. Once this has been accomplished, the gripper fingers 38, 39 release the welt portion and are displaced by cylinders 44, 50 back to the FIG. 1 position.

The distance x, FIG. 3C, between the spreader fingers 60, 62 is sufficient to permit a pair of loading fingers 80, 82 on the turret assembly 26 to pass therebetween and into the open welt end of blank 20. At this time a fluid cylinder 84, associated with the loading fingers, displaces finger 82 relative to finger 80 and expands the welt portion of the blank to a distance y, FIG. 3D, which is greater than the distance x, thus removing the blank from fingers 60, 62. After the blank is picked up by the fingers 80, 82 the cylinder 72 displaces the movable finger 62 to a collapsed position adjacent finger 60. The indexing turret assembly 26 includes a rotatable hub 88 having a plurality of hosiery blank support units 90 radiating therefrom. The hub includes a shaft rotatable in bearings, not shown, upon a base support stand 89. The hub 88 and units 90 preferably are controlled to rotate in intermittent steps, having a selected time interval between successive steps, in a prescribed manner by a drive motor. The support units 90 are loaded sequentially each time a unit indexes is past the spreader fingers 60, 62. While six units 90 have been shown, it is to be understood that the number of units may vary depending upon the operational speed of the turret assembly, the pick-up assembly 24 and toe closing machine 28.

Figure 4:
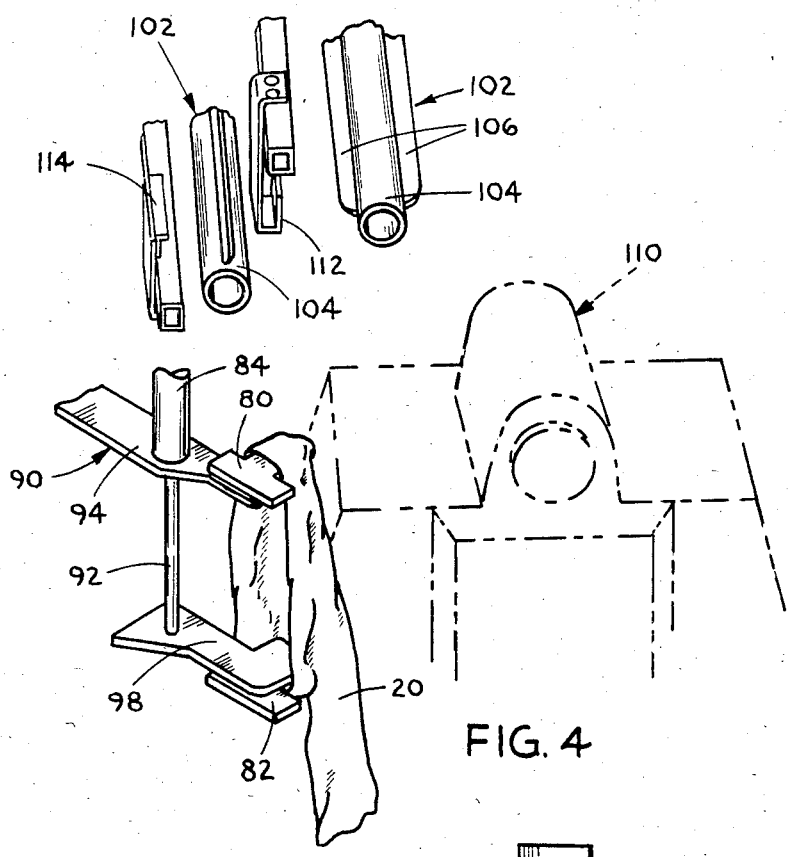
FIG. 4 is an enlarged perspective view of a portion of the apparatus of FIG. 1 with the blank being held upon the support fingers prior to being drawn into a suction tube for inversion before sewing closed the toe end of the blank.

Each of the supports units 90 includes an arm 94 radiating from the hub 88, a double acting fluid cylinder 84 and loading fingers 80, 82. The cylinder is secured to the arm adjacent the outer end thereof, and the rod 92 of the cylinder passes through an opening in the arm and has the finger 82 secured thereto. referring to FIGS. 4 and 9, the upper loading finger 80 is pivotably secured to the outer end of the arm 94 by hinge 96, and the lower loading finger 82 is pivotably secured to plate 98 by hinge 100. Plate 98 is, in turn, attached to the end of piston rod 92.

Figure 2:
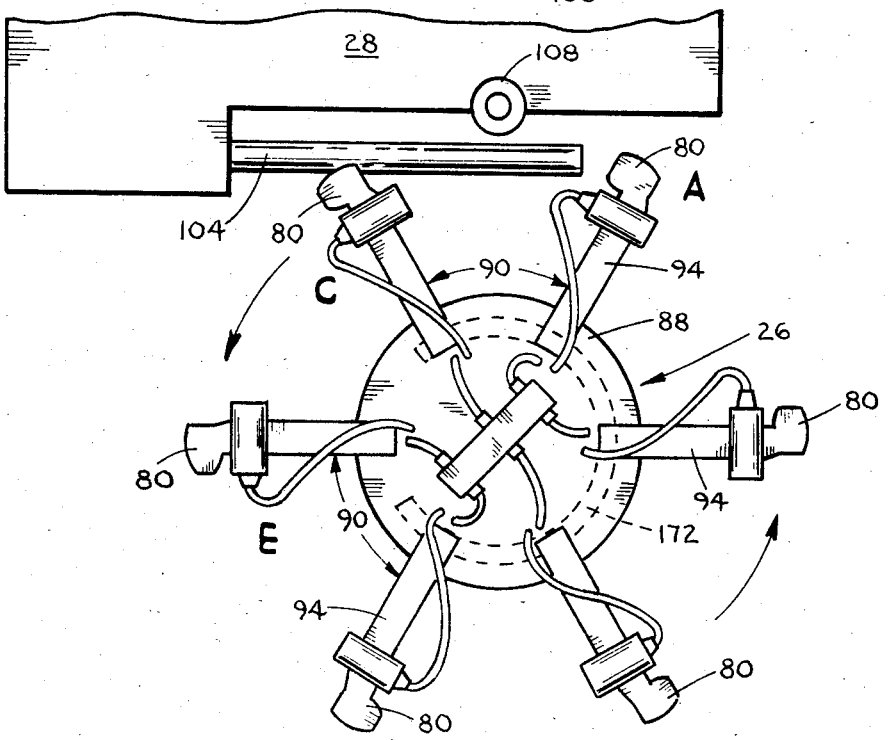
FIG. 2 is a top plan view of the turret assembly of FIG. 1 and a portion of the toe closing machine.

After a blank 20 has been positioned upon fingers 80, 82 and moved from fingers 60, 62, as shown by FIG. 3D, intermittent displacement of the turret assembly in a counterclockwise direction, FIGS. 1 and 2, carries a blank to an automatic toe closing machine 28. The toe closing machine may be of a type manufactured by Takatori Machinery Works, Inc., and as disclosed by U.S. Pat. No. 3,941,069. The toe closer is provided with a plurality of displaceable support units 102, each of which includes an elongated tube 104 and opposed finger pieces 106 capable of being displaced axially relative thereto. Wind-on wheels 108 facilitate positioning the blanks on the tubes, and the finger pieces 108 are selectively projected beyond the ends of the tube to present the toe portions of the blanks to sewing instrumentalities 110 for closing the toe end of the blanks.

Figure 5:
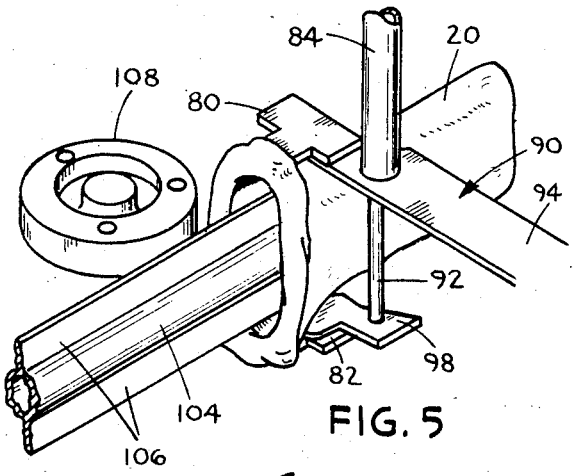
FIG. 5 is a perspective view of the blank support fingers of the turret as they are everting the blank and placing the blank upon the suction tube.

The toe closer 28 operates in a conventional manner described in U.S. Pat. No. 3,941,069. As a support unit 90 is indexed to position A, FIG. 2, and a loading tube 104 has been indexed to the proper position, suction in the loading tube picks up the blank toe portion drawing it into the tube. The welt portion is still being held in a stretched condition by fingers 80, 82. As the turret assembly 26 is again indexed, the blank is everted as it is withdrawn from within the tube and over the exterior portions thereof and fingers 106, as shown by FIG. 5. As the blank reaches the wind-on wheel 108, the wheel is driven to strip the blank from fingers 80, 82 and to position the blank completely on the tube 104 for subsequent positioning of the toe portion prior to sewing. Cams 112, 114 also are provided to pivot the fingers 80, 82 to facilitate removal of the blank from the fingers.

Figure 7:
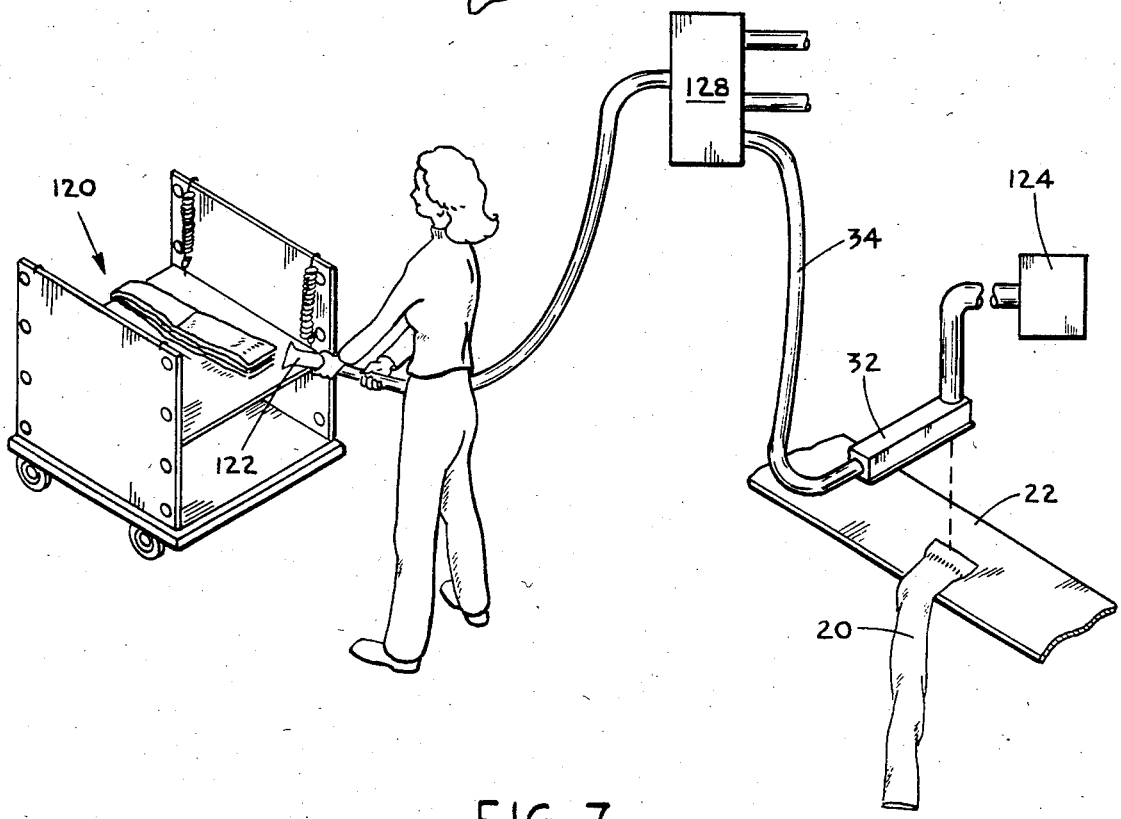
FIG. 7 is a schematic, perspective view of one method of placing garment blanks upon the conveyor for displacement to the pick-up assembly.

Individual hosiery blanks 20 may be directed from a supply means 120 to the conveyor 20, as shown by FIG. 7. An operator utilizes a vacuum pick-up wand 122 for picking up individual blanks and conveying them sequentially through conduit 34 by means of the vacuum source 124 to an orienting device 32. As illustrated by FIG. 7, all hosiery blanks are directed to a single orienting device 32 and deposited upon the conveyor 22. Depending upon operator's speed and efficiency a sufficient quantity of blanks may be deposited upon the conveyor to supply blanks to two or more pick-up devices 24 and associated toe closing machines 28. The system may be programmed so that a particular pick-up assembly selectively picks up prescribed blanks from conveyor 22, while other blanks may proceed to subsequent pick-up assemblies. As shown by FIG. 1, the pick-up assembly lifts selected blanks from the conveyor while others remain on the conveyor for pick-up by other assemblies.

Rather than an operator supplying all blanks to one conveyor, the blanks picked up by wand 122 may be directed to a manifold 128 for equal distribution to a plurality of conveyors.

Figure 8:
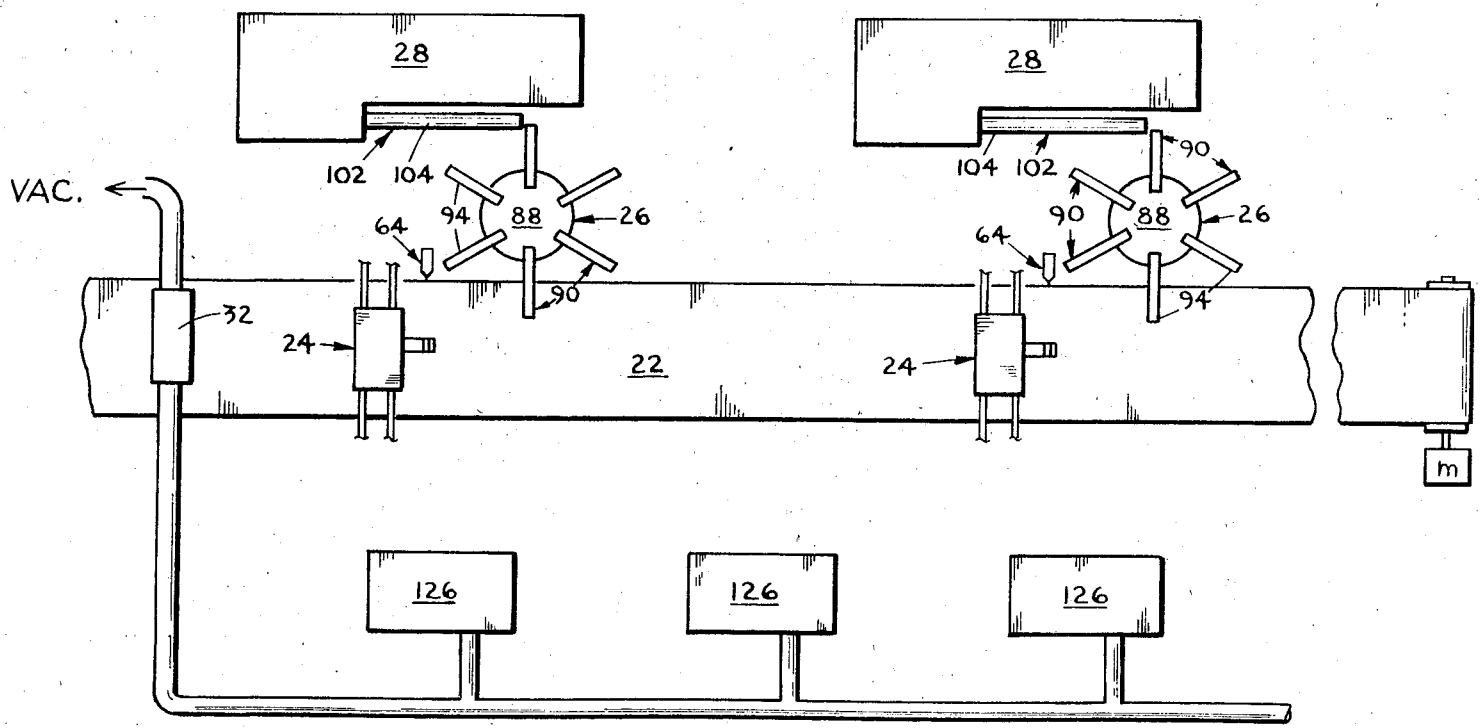
FIG. 8 is a schematic top plan view of another method for directing blanks from knitting machines to a pick-up assembly.
Figure 10:
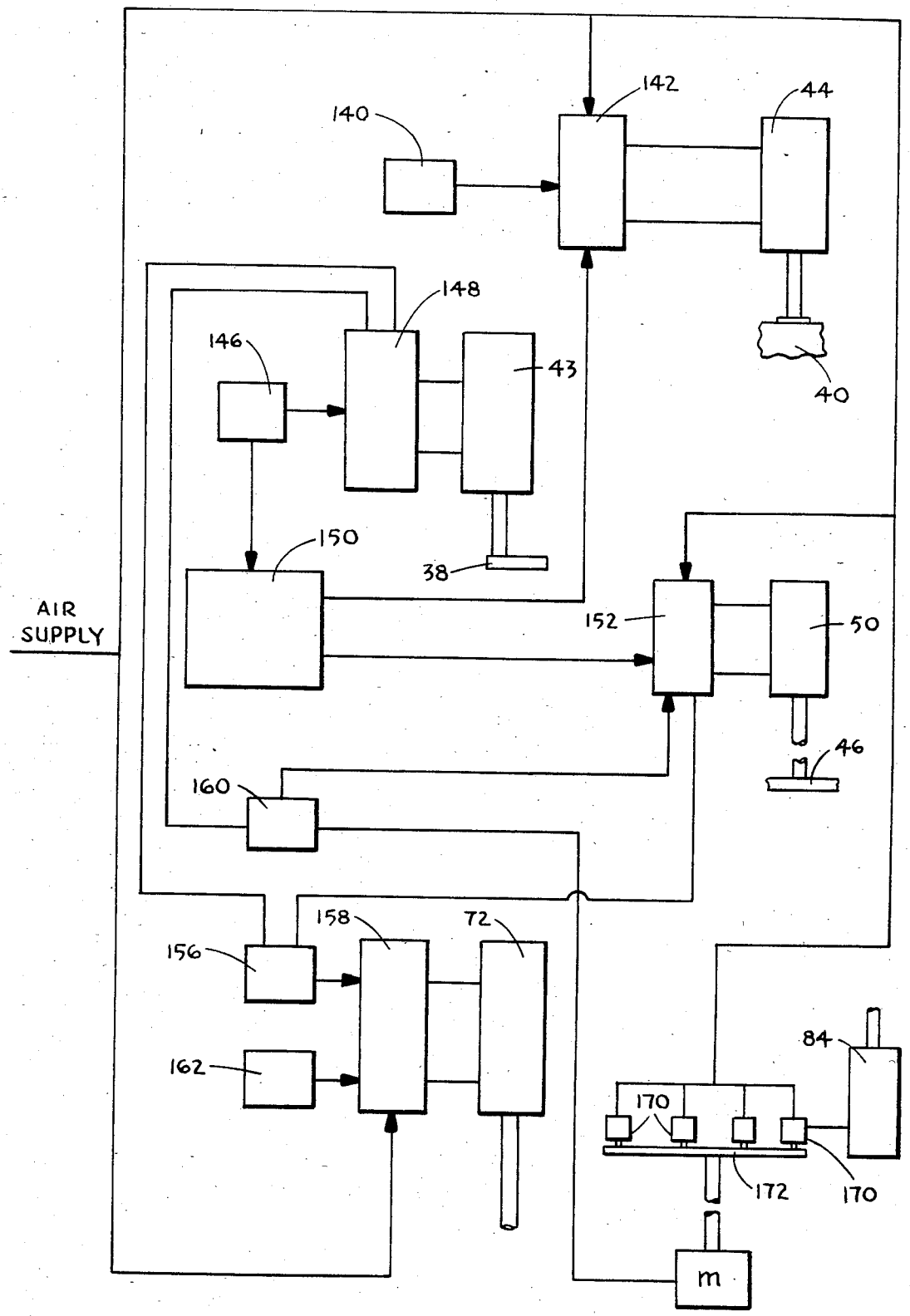
FIG. 10 is a schematic block diagram of the various control components.

FIG. 8 illustrates still another embodiment wherein knit hosiery blanks are conveyed directly from one or more knitting machines 126 to an orienting device 32. Here again, depending upon the producting rate of the knitting machines, the number of knitting machines couple to a common vacuum conveyor, etc., the hosiery blanks from a plurality of machines may be directed to a common manifold which selectively directs each blank to a prescribed conveyor.

The operation of the embodiment of FIGS. 1–2 will now be described. Normally the pick-up fingers 38, 39 are open, the carriage 40 is held in a raised position by cylinder 44 and the carriage 46 is positioned to the left of the rails 48, FIG. 1.

A sensor 140 is positioned above the belt 22 and may be attached to support 52. When sensor 140 detects an article 20 on conveyor belt 22, it activates a solenoid operated four way valve 142 which, in turn, controls cylinder 44 to initiate downward movement of the carriage 40. When the carriage 40 moves to the lower position it is detected by a sensor 146 which, through solenoid operated valve 148 and cylinder 43 moves finger 38 relative to fixed finger 39 to grip the welt portion of the article on the conveyor 22. Simultaneously, the sensor 146 sends a signal to a control assembly 150 which includes a timing mechanism. The control assembly 150, through valve 142 and cylinder 44, starts upward movement of carriage 40 and the pick-up fingers 38, 39 and displacement of the carriage 46 to the right, FIG. 1, by means of a solenoid operated four way valve 152 and cylinder 50.

The spreader fingers 60, 62 normally are in closed position. When the article 20, gripped by fingers 38, 39 is moved into position over spreader fingers 60, 62, its presence is detected by sensor 156. The sensor 156, through a solenoid operated four way valve 158 activates cylinder 72 to move finger 62 downwardly with respect to finger 60 thus spreading open the welt portion of the blank. In addition, sensor 156 also controls valves 148 and 152 to open pick-up fingers 38, 39 and move carriage 46 back to the left-most position, FIG. 1.

When the cylinder 72 moves the spreader finger 62 and support arm downwardly to a prescribed position, sensor 160 is activated by its presence and sends a signal to motor M to index or advance the turret assembly 26 one position (60°) and stop.

Positioned beneath each arm 94 of the turret assembly is a ball valve 170 which controls an associated fluid cylinder 84 for opening the loading fingers 80, 82. The ball valves 170 are controlled by a fixed cam 172, FIG. 2.

As an arm 94 and fingers 80, 82 are indexed 60° by motor M collapsed fingers 80, 82 move into the welt portion of the blank held open by spreader fingers 60, 62. As the fingers 80, 82 pass through fingers 60, 62 the associated ball valve 170 engages cam 172 at position E thus controlling cylinder 84 to expand the fingers 80, 82 and remove the article from the fingers 60, 62. The cylinder 84 permits the fingers 80, 82 to collapse as the ball valve 170 rides off of the cam 172 at position C, FIG. 2.

As the arm 94 of the turret assembly passes by a sensor 162 the arm is detected and sensor 162, through valve 158 and cylinder 72, displaces the finger 62 upwardly to close fingers 60, 62.

Figure 11:
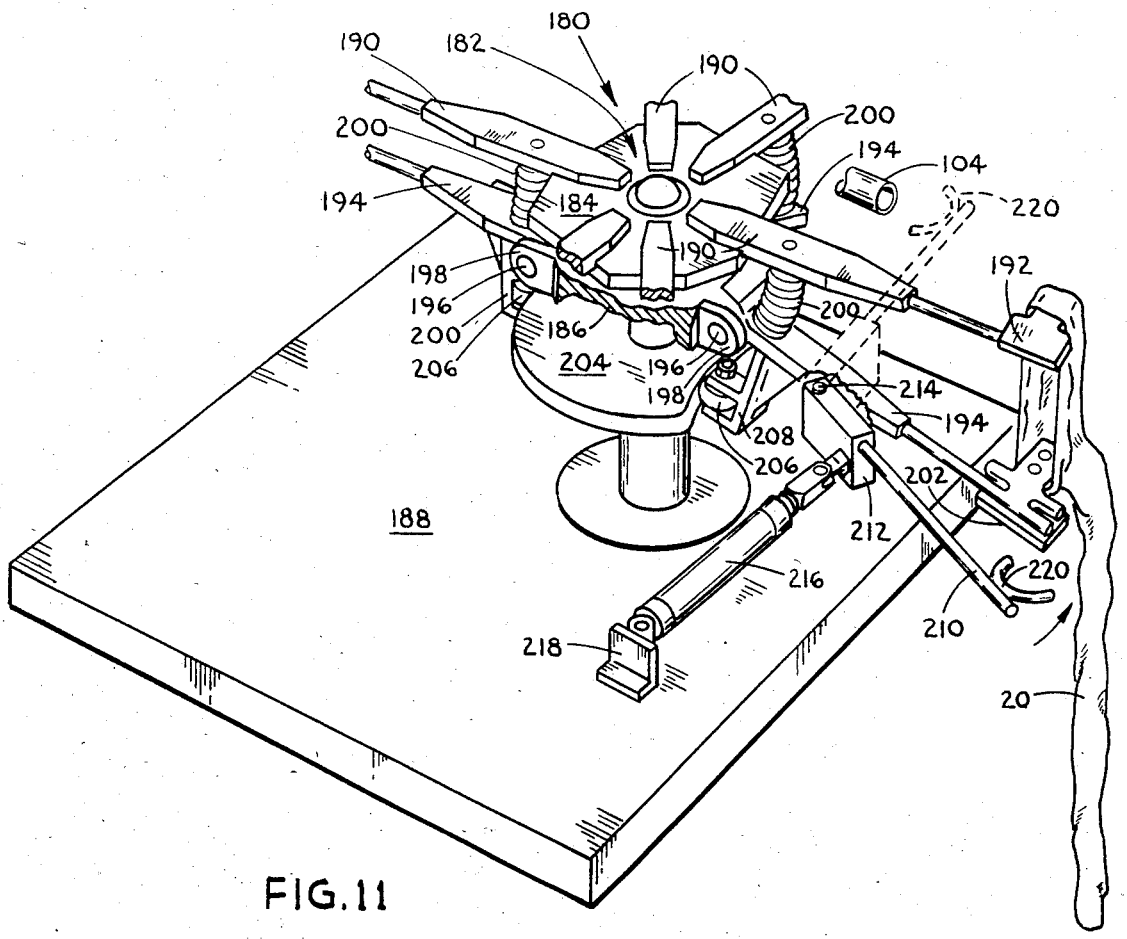
FIG. 11 is a fragmentary, schematic, perspective view of a modified embodiment of a turret assembly and a portion of the toe closing machine.

FIG. 11 illustrates a modified turret assembly 180 which eliminates the fluid cylinders 84 and controls for displacing fingers 82 with respect to fingers 80, and provides a cam action for displacing one support finger relative to a cooperating support finger. The assembly 180 includes a rotatable hub 182 and vertically spaced plates 184 and 186. The assembly is mounted upon a support structure 188 and drive by a motor, not shown, in a manner similar to the turret assembly 26 of FIG. 1.

The upper plate 184 has a series of six arms 190 rigidly secured thereto and radiating therefrom. At the outer end of each arm is a finger 192, which is identical to finger 80 of FIGS. 1 and 9, and which is pivotably secured to the arm 190.

The plate 186 also is provided with a series of six arms 194 which are vertically spaced below and in alignment with arms 190. Although only portions of three lower arms have been shown, each is mounted for limited pivotable movement upon pins 196 supported by spaced brackets 198 which are fixed to plate 186. Each of the lower arms 194 is provided with a pivotable finger 202 similar to fingers 82 in the embodiment of FIGS. 1 and 9. Located between each pair of vertically spaced arms 190, 194 and outwardly of plates 184, 186 is a coil spring 200 which normally urges arm 194 away from arm 190.

Figure 12:
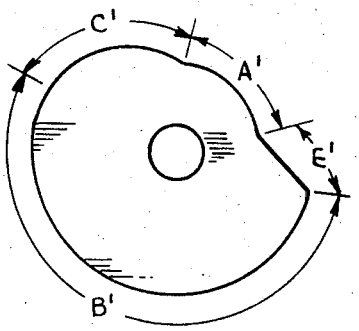
FIG. 12 is a top plan view of the cam for controlling the movement of the lower fingers of the support units.
Figure 16:
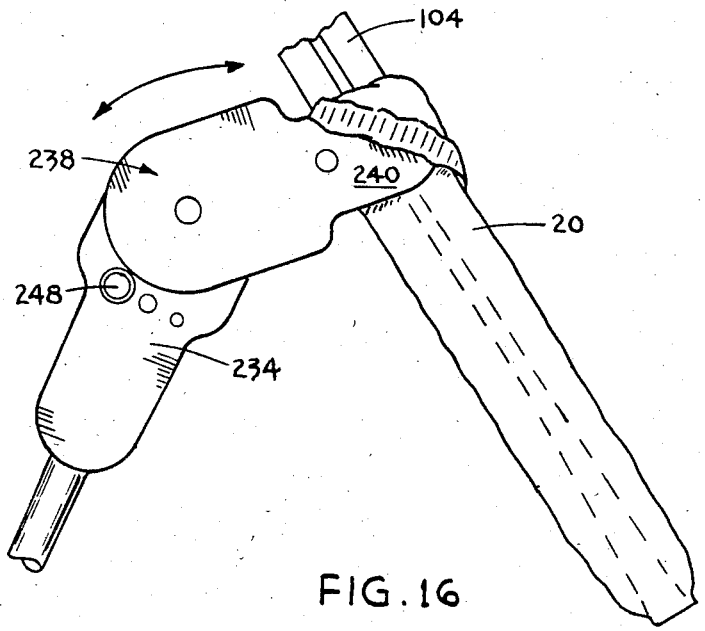
FIG. 16 is a top plan view of the upper loading finger of FIG. 15 having the welt end of a blank supported thereon and illustrating the pivoting action of the finger to release the blank as it is pulled onto the suction tube of the toe closer.

Each pair of arms 190, 194 normally are maintained in parallel relation, as shown by the leftmost pair of arms 190, 194, FIG. 11, by a cam 204 and followers 206. The cam is fixed with respect to the rotatable hub 182, and the followers 206 are located in positions below arms 194 and rotatably mounted and brackets 208 fixed to the arms 194. Referring to FIG. 12, as the follower 206 of a pair of arms moves along section B′ of cam 204, which is a constant radius, the upper and lower arms 190, 194 remain in a substantially parallel relation. As the follower gets to section E′ on the cam, the follower 206 is urged inwardly by the weight of the arm 194 and its associated compression spring 200, as shown by the pair of arms located at the right side of FIG. 11, to spread open the welt portion of a blank 20. The arms 190, 194 and fingers 192, 202 remain in a spread position as the article is picked up by suction tube 104 of the toe closer and inverted by being pulled over the outside of the tube as previously described and shown by FIGS. 1, 2 and 5. This is accomplished as the follower 206 moves along cam section A′, which is a portion of a circle. As the follower 206 reaches cam section C′ the arms begin to gradually close bringing fingers 192, 202 closer together to facilitate releasing of the blank positioned on tube 104, as the blank is acted on by the wind-on wheel of the toe closer machine. The arm should be completely closed when the follower reaches section B′ on the cam 204.

The design of the cam may vary depending upon the position of the turret assembly with respect to tube 104 of the toe closing machine and the fingers 60, 62 of spreader apparatus 64. However, the fingers 192, 202 should index to remove the article 20 from spreader fingers 60, 62 at some location along the cam section B′ when the arms are closed and preferably just prior to expanding arms 190, 194 and fingers 192, 202.

FIG. 11 also disclosed an apparatus for engaging the blank portion depending from fingers 192, 202 and for carrying the toe portion to suction tube 104. This mechanism includes an arm 210 secured to a pivoted block 212 mounted for rotation about pin 214. A double acting cylinder 216 is coupled to a bracket 218 on support 188 and to block 212 for swinging counterclockwise the arm 210 through an arc between the full line and dotted line positions. At the outer end of 210 is an arcuate member 220 which engages the blank 20 as it is moved through an arc from the full line position to the dotted line position to present the toe portion to the suction tube 104.

This mechanism could also be mounted upon the support 89 of the embodiment of FIG. 1 for conveying a blank to the tube 104.

FIGS. 13–16 illustrate still another embodiment of the support finger assemblies for receiving a blank from the spreader fingers 60, 62 and carrying it to a loading suction tube 104. Rather than having one finger displaceable towards and away from another, as fingers 80, 82 in FIG. 1 and fingers 192, 202 in FIG. 11, cooperating pairs of finger assemblies may be vertically fixed with respect to each other. As shown, for example, by FIG. 15, the upper finger assemblies 230 are adapted to be rigidly secured to the arms 94 of FIG. 1 or to the upper arms 190 of the FIG. 11 embodiment. The lower finger assemblies 232 also are rigidly secured to arms 94 or 190, or other support means. The lower assembly 232 is a mirror image of assembly 230.

Figure 13:
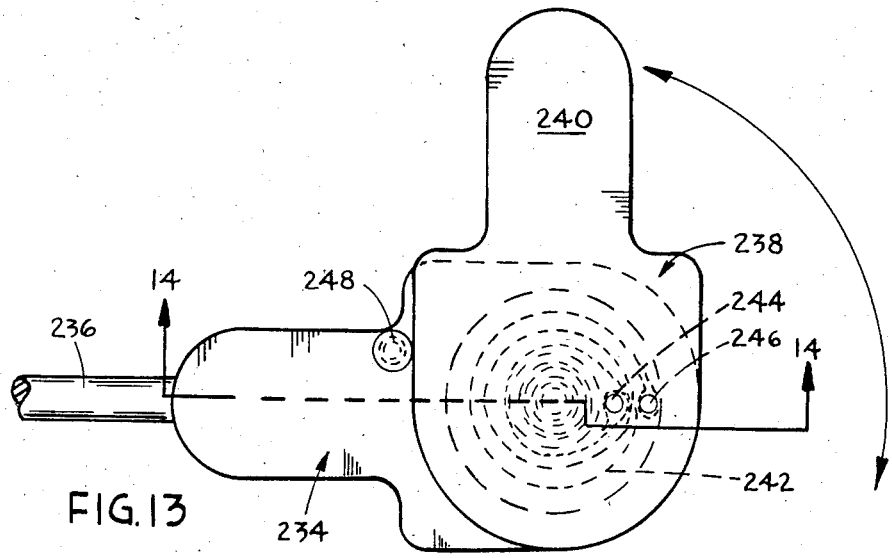
FIG. 13 is a top plan view of a modified embodiment of loading fingers.
Figure 14:
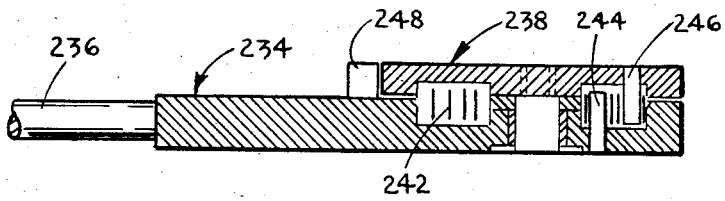
FIG. 14 is a sectional view taken along line 14—14 of FIG. 13.

Referring to FIGS. 13 and 14, each finger assembly 230, 232 includes a first section 234 adapted to be welded or otherwise fixedly secured to a rod 236 which is coupled to a support arm. Each assembly also includes a second section 238 which is pivotably mounted upon the first section 234 and includes the finger 240 over which the welt portion including the waist band of the hosiery blank 20 is placed. Adjacent portions of sections 234, 238 have been cut away to provide a recess for receiving a spring 242 having end portions connected to section 234 and 238 by post 244 and 246, respectively. The spring 242 normally biases the section 238 to abutment with a stop member 248 as shown by FIGS. 13, 14 and in the full line positions of FIG. 15.

Use of finger assemblies of this type on the turret assembly would eliminate the fluid cylinders 84 of the embodiment of FIG. 1 and would also elminnate the lower arms 194, coil springs 200 and cam 204 of the embodiment of FIG. 11.

Figure 15:
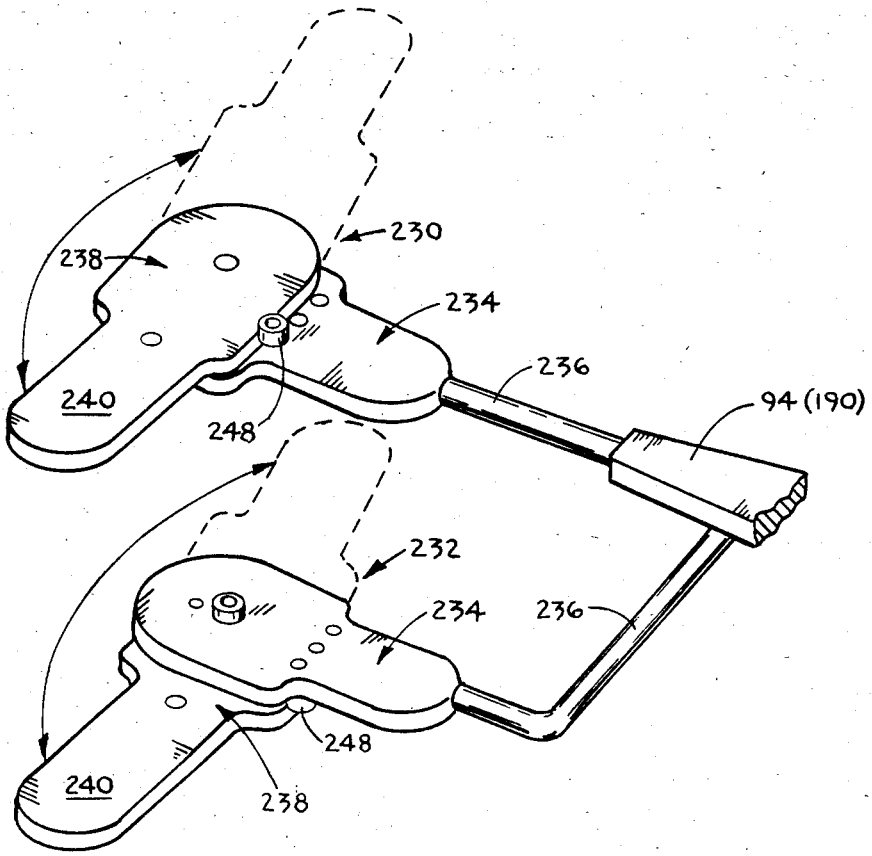
FIG. 15 is a perspectrive view of cooperating upper and lower loading fingers of the embodiments of FIGS. 13 and 14.

During normal operation, a pair of fingers located in the full line positions of FIG. 15 would be indexed to pick up a blank from spreader fingers 60, 62. The spacing between upper and lower fingers 240, 240 is sufficient to retain the blank 20 waist band in a stretched condition. As the turret continues to index the fingers 240, 240 and the blank, the toe end is directed into the tube 104 of the toe closing machine. Continued movement of the fingers pulls the blank from within the tube 104 and over the exterior portions thus everting the blank. When the article is pulled onto the tube 104 the springs permit pivoting of the finger sections 238 with respect to sections 34 and the article waist band slides of the fingers 240 due to the action of the wind on wheel 108. The springs then return the finger sections 238 to the FIG. 13 position abutting stops 248.

What is claimed is:

1. The method of conveying a tubular hosiery blank having a welt end portion and a toe end portion to an elongated suction tube of a toe closing machine having sewing instrumentalities comprising the steps of; transferring the hosiery blank from a supply source to a conveyor, orienting the blank in a prescribed manner upon the conveyor with the welt end portion positioned upon the conveyor, conveying the blank to a prescribed location, gripping the welt end portion and transferring the blank from the conveyor to a predetermined position, spreading open the welt end portion of the blank at the predetermined position, conveying the blank along an arcuate path to an elongated suction tube of a toe closing machine, positioning the blank upon the elongated suction tube while maintaining the welt end in an expanded condition and everting the blank.

2. The method as recited in claim 1, wherein the supply source is a knitting machine, and the blank is transferred pneumatically from the knitting machine, and wherein the blank is oriented by urging the welt and toe ends of the blank in opposite directions to extend the blank as the blank is deposited upon the conveyor.

3. The method as recited in claim 2, wherein the oriented blank is transferred from the conveyor by gripping the uppermost layer of fabric of the welt end lifting the gripped blank such that the welt end is in a prescribed location.

4. The method of conveying a series of tubular hosiery blanks, each having a welt end portion and a toe end portion, to a toe closing machine having sewing instrumentalities and elongated support tubes for receiving blanks comprising the steps of: conveying a series of blanks randomly discharged from a supply source to a predetermined location, sequentially discharging the blanks from the predetermined location onto a conveyor in a prescribed, oriented condition with the welt end portions selectively positioned upon the conveyor, displacing the conveyor to convey a plurality of the oriented blanks along a predetermined path, selectively removing the blanks from the predetermined path by gripping and displacing the blank welt portion to a prescribed position spaced from said predetermined path, spreading open the blank welt end portion, and conveying the blank along a predetermined path while maintaining the welt portion in an expanded position to position the blank upon a tube.

5. The method of conveying a series of hosiery blanks, each having a welt end portion and a toe end portion, to a toe closing machine comprising the steps of: pneumatically conveying a series of blanks to a first prescribed location, sequentially orienting the blanks in a prescribed manner with the welt end portions positioned upon a conveyor, displacing the conveyor transfer the tubular blanks upon the conveyor to a second prescribed location, sequentially gripping the blank welt portions at said second prescribed location, transferring the gripped blank welt portion to a third prescribed location, expanding open the tubular welt portion at said third prescribed location and conveying the blank and expanded welt portion along a predetermined path to a toe closing machine.

6. The method as recited in claim 5 wherein each oriented blank is transferred from the support surface by gripping the uppermost layer of fabric of the welt end portion and conveying the welt end portion to the second prescribed location.

* * * * *